US007298071B2

(12) United States Patent
Hitzschke et al.

(10) Patent No.: US 7,298,071 B2
(45) Date of Patent: Nov. 20, 2007

(54) DISCHARGE LAMP HAVING AT LEAST ONE EXTERNAL ELECTRODE, ADHESIVE LAYER, AND CARRIER FILM

(75) Inventors: Lothar Hitzschke, München (DE); Frank Vollkommer, Buchendorf (DE)

(73) Assignee: Patent - Treuhand - Gesellschaft fuer Elektrische Gluehlampen mbH, Munich (DE)

( * ) Notice: Subject to any disclaimer, the term of this patent is extended or adjusted under 35 U.S.C. 154(b) by 386 days.

(21) Appl. No.: 10/954,611

(22) Filed: Oct. 1, 2004

(65) Prior Publication Data

US 2005/0077808 A1 Apr. 14, 2005

(30) Foreign Application Priority Data

Oct. 9, 2003 (DE) ..... 103 47 636

(51) Int. Cl.
*H01J 11/00* (2006.01)

(52) U.S. Cl. ..... 313/234; 313/607

(58) Field of Classification Search ..... 313/234, 313/607

See application file for complete search history.

(56) References Cited

U.S. PATENT DOCUMENTS

| | | | | |
|---|---|---|---|---|
| 5,604,410 | A | 2/1997 | Vollkommer et al. | |
| 5,925,988 | A | 7/1999 | Grave et al. | |
| 5,994,849 | A | 11/1999 | Vollkommer et al. | |
| 6,034,470 | A | 3/2000 | Vollkommer et al. | |
| 6,150,758 | A * | 11/2000 | Tamura | 313/488 |
| 6,373,185 | B1 * | 4/2002 | Tyler | 313/491 |
| 2002/0011807 | A1 * | 1/2002 | Kobayashi et al. | 315/291 |

FOREIGN PATENT DOCUMENTS

| | | |
|---|---|---|
| EP | 0 871 203 A2 | 10/1998 |
| EP | 0 871 204 B1 | 10/1998 |
| EP | 0 871 205 B1 | 10/1998 |
| JP | 54-119785 | 9/1979 |
| JP | 2003-220092 | 8/2003 |
| WO | 03/017312 | 2/2003 |

OTHER PUBLICATIONS

Abstract, JP 54-119785 (Sep. 17, 1979).

* cited by examiner

*Primary Examiner*—Joseph Williams
*Assistant Examiner*—Bumsuk Won
(74) *Attorney, Agent, or Firm*—Robert F. Clark

(57) ABSTRACT

In a discharge lamp having a discharge vessel and external electrodes, at least one electrode similar to a conductor track is an integral part of a laminate (5) which is adhesively bonded to the outer side of the discharge vessel and includes a carrier film made of electric insulating material.

1 Claim, 3 Drawing Sheets

DISCHARGE LAMP HAVING AT LEAST ONE EXTERNAL ELECTRODE, ADHESIVE LAYER, AND CARRIER FILM

TECHNICAL FIELD

The invention is based on a discharge lamp in which at least one electrode, also called the external electrode for short in the following text, is arranged on the outer side of the discharge vessel.

Discharge lamps of this type fall under the general designation "dielectric barrier discharge lamps (DBD lamps)", here the wall of the discharge vessel acting as a dielectric barrier for the respective electrode arranged on the outer side of the discharge vessel. The form of the discharge vessel plays a subordinate role in this connection, however. Known amongst others are tubular lamp types which, for example in office automation (OA), are used for photocopiers, fax machines and scanners, and also flat lamp types, which are used inter alia in general lighting, for film lamps and as backlighting for liquid-crystal displays (LCD).

BACKGROUND ART

U.S. Pat. No. 5,994,849 discloses a flat lamp having external electrodes. The discharge vessel comprises a flat baseplate and a trough-shaped front plate with a planar central region, the two plates being sealed to each other in a gas tight manner in the circumferential edge region. Adhesively bonded to the outer side of the baseplate are strip-like aluminum electrodes. This is not practicable in particular in large-area flat lamps having numerous strip-like electrodes, for example typically 42 items in a 17" flat lamp. One further possibility is to print electrode tracks made of conductive silver paste onto the outer side of the baseplate by means of a screen-printing technique, as is similarly also done in flat lamps having electrodes applied to the inner side of the discharge vessel wall (see, for example, U.S. Pat. No. 6,034,470). As compared with the previous technique, this technique has the advantage that even relatively filigree electrode tracks can be applied easily. However, the relatively high complexity is disadvantageous, particularly since, after the application of the initially pasty electrode tracks, a drying and subsequent baking step are additionally required, the baking generally additionally leading to embrittlement of the discharge vessel consisting of glass. Moreover, in both techniques, an additional measure has to be taken to cover the electrode tracks, in order to ensure the protection against contact and protection against further external influences. Otherwise, in the course of time, undesired changes can occur in the electrode tracks with the result of operational disruption as far as early failures of these lamps.

DISCLOSURE OF THE INVENTION

It is an object of the present invention to provide a discharge lamp having at least one external electrode which is simpler to fabricate. A further aspect is the improved reliability of the discharge lamp.

This object is achieved by a discharge lamp having a discharge vessel and having at least one electrode similar to a conductor track, which is adhesively bonded to the outer side of the discharge vessel, wherein the at least one electrode similar to a conductor track—also designated the electrode track in the following text for simplicity—is an integral part of a laminate which is adhesively bonded to the outer side of the discharge vessel by means of an adhesive layer and comprises a carrier film made of an electric insulating material.

In addition, protection is claimed for a process for the production of this lamp.

The advantage of the solution according to the invention is that the laminate can be prefabricated and can then be adhesively bonded in complete form to an outer side of the discharge vessel. The process is therefore also very suitable for automated mass production. In addition, the production of the lamp is more economical as a result. This solution is particularly advantageous in the case of discharge lamps having a plurality of strip-like electrodes, such as the flat lamp disclosed in U.S. Pat. No. 5,994,849 mentioned at the beginning, since then all the electrodes, together with the laminate, can be adhesively bonded to the discharge vessel in a single operation. Here, the adhesive can be applied separately to an area of the discharge vessel provided for the purpose immediately before the adhesive bonding of the laminate, or to the laminate itself. However, in order to simplify lamp fabrication it may also be advantageous for the laminate to already be provided with an adhesive layer. For improved stock keeping and handling during fabrication, the adhesive layer is preferably protected by a cover film, which is removed only immediately before the adhesive bonding of the laminate. In order that the adhesive layer does not inadvertently separate from the laminate when the cover film is pulled off, the adhesive layer preferably has a stabilizing agent, for example fibers embedded in the adhesive layer. Alternatively suitable as an adhesive layer is also a thin film serving as a stabilizing agent, which is coated on both sides with adhesive. In selecting the type and thickness of the adhesive, it is necessary to take into account that the adhesive layer fills all the cavities between the electrode tracks, in order that if possible no air inclusions arise during adhesive bonding. This is because, if relatively large air inclusions form, at this point some of the electrode tracks lift off the outer side of the discharge vessel, as a result of which, in the least beneficial case, the discharge fails at this point. This can in turn impair the homogeneity of the luminous density of the lamp to an unacceptable extent and is therefore undesired. For example, an adhesive such as is used in the tesa 4980 adhesive tape from Tesa AG has proven to be suitable. Good results were achieved with adhesive layers whose respective thickness lies in the range between about 40 to 200 μm, preferably between about 60 to 100 μm. In this case, it has surprisingly been shown that no undesirably large voltage drops occur across the electrodes.

The laminate is preferably oriented in such a way that the at least one electrode similar to a conductor track is arranged between the relevant outer side of the discharge vessel and the carrier film. This has the advantage that the carrier film, in addition to acting as a carrier, simultaneously acts as a protective film against external effects and as a protection against contact.

The laminate is preferably designed to be flexible. This may be achieved by means of suitable material selection and thickness of the carrier film and also of the electrode track(s) laminated thereto. For the carrier film, electrically insulating plastics, in particular the materials polyethylene naphthalate (PEN) or polyester (PET) but also polyimides (e.g. Kapton) have proven to be extremely suitable. The thickness of the carrier film is a few micrometers to a few hundred micrometers; it preferably lies in the range between about 5 μm and 200 μm, particularly preferably between about 20 μm and 100 μm. The at least one electrode similar to a conductor track consists of an electrically conductive material, in particular of metal, for example copper or aluminum. Its thickness preferably lies in the range between about 5 μm and 40 μm, particularly preferably between about 5 μm and 20 μm. The flexibility of the laminate achieved as a result makes it possible preferably to provide an integral feed line for the at least one electrode. This means that the electrode tracks are led onward in a region of the laminate similar to an extension, this extension not being adhesively bonded to the discharge vessel but remaining freely mobile and thus functioning as a film-like feed line. For the operation of the lamp, the free end of the film-like feed line is connected to the output of an electric supply appliance, either directly or by means of a plug connected to the feed line end. In any case, it is advantageous that it is possible to dispense with the otherwise usual soldering of a separate feed line to the discharge vessel.

The width of the electrode tracks depends on the electrical requirements of the lamp. For lamps which are provided for a pulsed operating mode disclosed in U.S. Pat. No. 5,604,410, the width of the electrode tracks is typically about 1 mm or else somewhat less or up to a few millimeters. The electrode tracks can be applied directly to the carrier film by means of screen printing, for example from silver solder. Alternatively, the electrode tracks can also be produced by means of conventional etching processes from a copper film laminated to the carrier film. The copper film can, for example, be adhesively bonded to the carrier film by means of an adhesive layer.

Likewise, it is conceivable to provide the carrier film directly with a copper layer.

A first embodiment relates to what are known as aperture lamps having external electrodes, which have a tubular discharge vessel. This lamp type has at least one, typically two, strip-like external electrodes, which are oriented parallel to the longitudinal axis of the tubular discharge vessel. According to the invention, at least one electrode track laminated to a carrier film is adhesively bonded on parallel to the longitudinal axis of the tubular discharge vessel. In the case of two parallel electrode tracks, these are laminated into the carrier film with a predefined mutual spacing. This means that, after the laminate has been adhesively bonded on to the outside of the tubular discharge vessel, the two electrode tracks are arranged at the desired position. In addition, the laminate is adhesively bonded on in such a way that the aperture of the lamp, through which the light is emitted, remains free. As compared with the conventional solution, in which a translucent heat-shrink tube of plastic is subsequently applied to the electrodes typically adhesively bonded on, this has the advantage that here there is no reduction of the luminous flux passing through the aperture as a result of a heat-shrink tube.

In a particularly preferred embodiment, the discharge lamp has a flat discharge vessel—also designated a flat lamp in brief in the following text—having a large number of electrodes similar to conductor tracks (electrode tracks), which are distributed uniformly over the area of the discharge vessel. The electrode tracks are arranged on a common carrier film in at least two comb-like, interengaging electrode groups. This laminate, formed in this way, is normally adhesively bonded to the rear of the flat discharge vessel—that is to say the outer side of the surface opposite the light emission direction. In the case of the large number of electrode tracks required in a large-area flat lamp, the aforementioned advantages of the invention of course come particularly to fruition. For this purpose, the electrode tracks, including the collector tracks, with which the electrode tracks form comb-like electrode groups, and any possible feed lines to these electrode groups, are for example exposed from a carrier film coated with copper by exposure and etching processes conventional in electronics or, alternatively, are applied directly to the carrier film from silver solder paste by means of a screen-printing technique. In this case, the electrode tracks do not necessarily have to be completely rectilinear but can also have a substructure, as shown in the following exemplary embodiment. In any case, the laminate prepared in this way is then provided with an adhesive layer, preferably on the electrode side, and then adhesively bonded to a surface, for example the rear of the discharge vessel of the flat lamp. In this case, in a relatively new type of DBD flat lamp, in which during operation a large number of individual discharge structures are formed between the supporting projections integrally molded into the front plate, particularly high requirements are placed on the positional accuracy of the electrode tracks, since the individual discharge structures are intended to be formed only at the points predetermined by the particular shaping of the front plate. It has surprisingly been shown that this can be implemented with a prefabricated and subsequently adhesively bonded laminate with such high accuracy that flat lamps of this type even having relatively large diagonals, for example 23" and more, can be produced. For further details relating to the shaping of these flat lamps, reference is made to WO 03/017312.

BRIEF DESCRIPTION OF THE DRAWINGS

In the following text, the invention is to be explained in more detail using an exemplary embodiment. In the figures.

BEST MODE FOR CARRYING OUT THE INVENTION

Figure 1A:
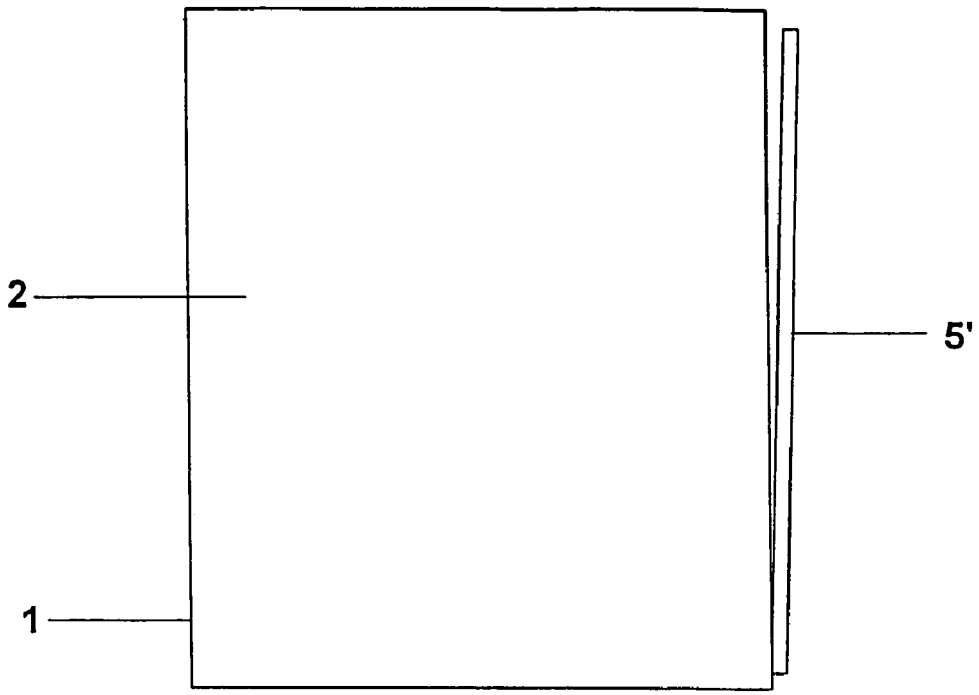
FIG. 1*a* shows the plan view of a flat lamp.
Figure 1B:
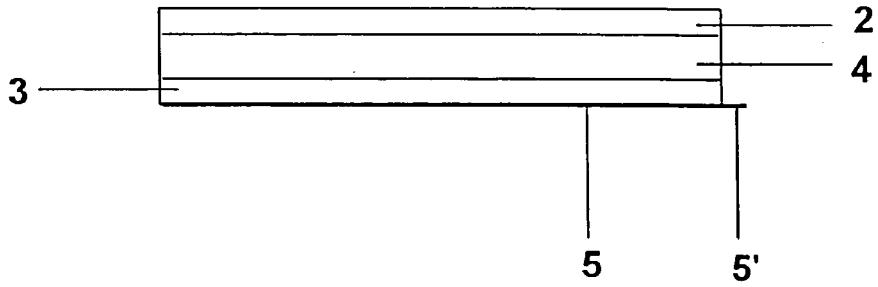
FIG. 1*b* shows the side view of the flat lamp from FIG. 1*a*.

FIGS. 1*a*, 1*b* show in schematic form a flat lamp 1 having a diagonal of 21.3" and a side ratio of 4:3 in plan view and side view, respectively. The discharge vessel of the flat lamp 1 is formed by a front plate 2, a baseplate 3 and a frame 4 arranged between them, the frame 4 connecting the two plates 2, 3 to each other in a gas tight manner. Alternatively, it is also possible to dispense with a frame if baseplate and front plate are not both completely flat but, at least in the edge region, are shaped in such a way that the frame is, as it were, incorporated in at least one of the two plates. For further details in this regard, reference is made to the documents U.S. Pat. No. 5,994,849 and WO 03/017312 already cited, whose disclosure content in this regard is hereby incorporated by reference. In the interior of the discharge vessel there is xenon and neon with a partial filling pressure of about 10 kPa and about 20 kPa, respectively. Adhesively bonded to the outer side of the baseplate 3 is a laminate 5, whose structure is illustrated roughly schematically in FIG. 2. An extension 5' of the laminate 5 which is not adhesively bonded on is used as a flexible feed line. Closer details relating to this will be found in the description relating to FIG. 3.

Figure 2:
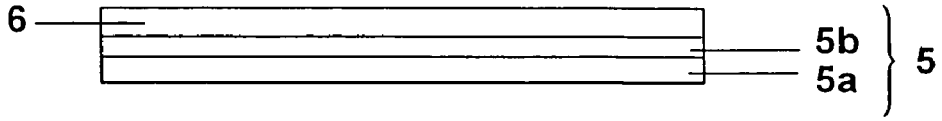
FIG. 2 shows the side view of the laminate, including the adhesive layer, bonded to the outer side of the flat lamp from FIGS. 1*a*, 1*b*.

For the following explanation, reference will now be made to FIG. 2, just mentioned. The outermost layer of the laminate 5 is formed by a carrier film of PET (polyester) which is about 50 μm thick, which serves simultaneously as a protective film for electrode tracks 5*b* of copper about 15 μm thick located above (for details see FIG. 3). This is finally followed by an adhesive layer 6 about 80 μm thick, with which the laminate 5 is adhesively bonded to the outer side of the baseplate 3. The adhesive used in the adhesive layer 6 is the adhesive used in the tesa 4980 adhesive tape from Tesa AG.

Figure 3:
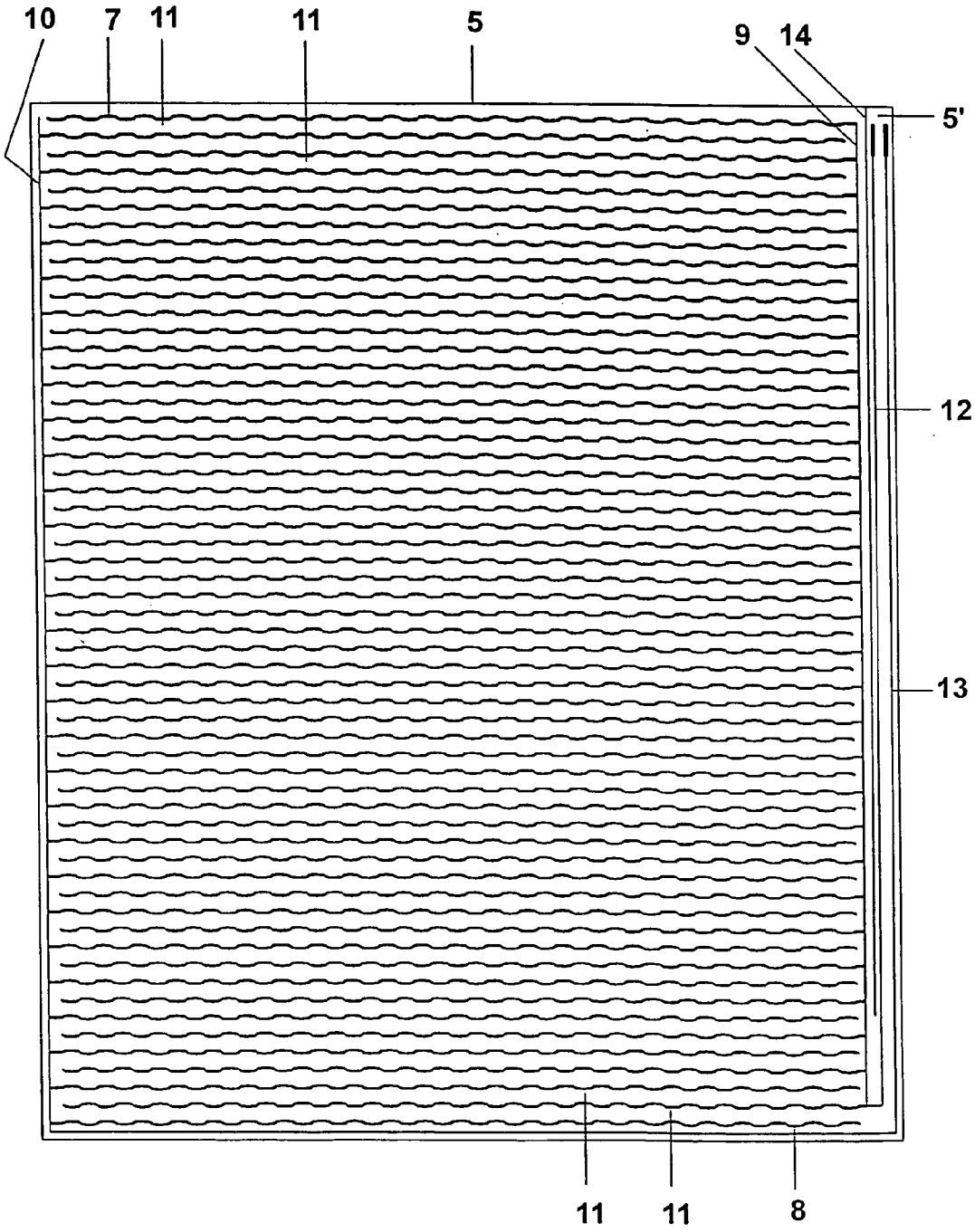
FIG. 3 shows a plan view of the laminate from FIG. 2 with electrode tracks.
Figure 4:
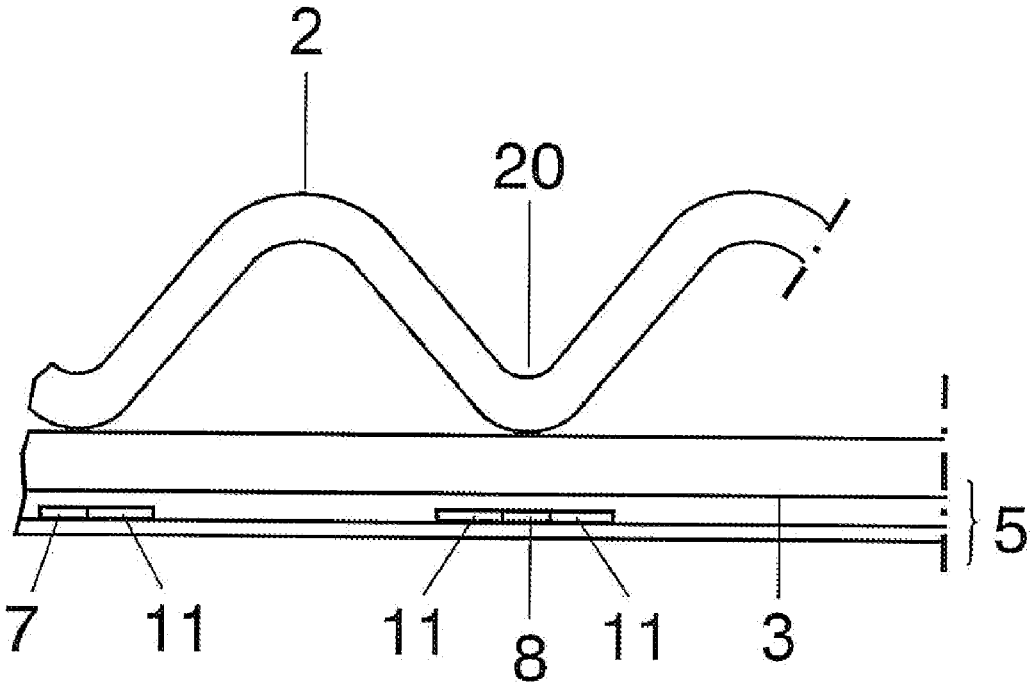
FIG. 4 shows a cross-sectional illustration of an embodiment of a flat lamp.

FIG. 3 shows the copper layer side of the laminate 5 in plan view. This comprises, in turn, 29 electrode tracks 7 which are affanged in parallel beside one another and with a mutual spacing from one another, which are provided for a first polarity, and also 29 just such electrode tracks 8, which are provided for a second polarity, an electrode track 7 of the first polarity continuously alternating with an electrode track 8 of the second polarity. On opposite sides, the respective end of each electrode track 7, 8 of one polarity is combined to form a collector track 9, 10. In this way, the electrode tracks 7, 8 with their associated collector tracks 9, 10 form comb-like structures, the structures of the two polarities interengaging, so to speak. The individual, substantially rectilinear electrode tracks 7, 8 have a wave-like substructure running in opposite directions, which means that a large number of narrow points 11 are formed between two immediately adjacent electrode tracks 7, 8. At each of these points 11, in the pulsed operation mentioned at the beginning according to the already cited U.S. Pat. No. 5,604,410, an individual discharge is formed (not illustrated). In the variant illustrated in FIG. 4, the laminate 5 is adhesively bonded to the outer side of the baseplate 3 of a flat lamp which, as already mentioned at the beginning, has numerous supporting projections 20 integrally molded into the front plate 2, by which means points for individual discharges are predetermined between the supporting projections. In this variant, given correct position of the laminate, the aforementioned narrow points 11 of the electrode tracks 7, 8 and the points predetermined by the individual discharges are coordinated exactly with one another. The center spacing of the electrode tracks is 4.5 mm, their width about 1.45 mm. In two variants which are not illustrated, the electrode track width is 2.05 mm and 0.85 mm, respectively. The collector tracks 9, 10 in turn merge into feed tracks 12, 13, which lead in parallel along an edge region of the carrier film 5*a*. All the copper tracks 7-13 have been produced by means of conventional etching processes from a copper film laminated to the carrier film 5*a*. Before the laminate 5 is adhesively bonded to the outer side of the baseplate 3 of the discharge vessel, the laminate 5 is cut along a line 14, which separates the feed line tracks 12, 13 from the electrode tracks 7, 8 and the collector track 9. As a result, the strip-like extension 5' of the laminate 5 having the two feed line tracks 12, 13 is mobile after the remainder of the laminate 5 has been adhesively bonded on, and is then used to connect the lamp to an electric supply appliance (not illustrated). In this way, each of the two comb-like electrode groups is ultimately connected to one pole of the supply appliance. For the purpose of protection against external influences and contact, the two feed line tracks 12, 13 are covered with an additional insulating layer (not illustrated), with the exception of their respective connecting end.

Although the invention has been explained above using the example of a flat lamp, the advantageous effect of the invention and of the protection claimed also extends, so to speak, to discharge lamps according to the invention having discharge vessels shaped in another way, in particular also to tubular discharge lamps.

What is claimed is:

1. A discharge lamp having a flat discharge vessel, a front plate having a plurality of integrally molded supporting projections, and a plurality of electrodes similar to conductor tracks that are distributed uniformly over an area of the discharge vessel and which are adhesively bonded to an outer side of the discharge vessel, wherein immediately adjacent electrodes similar to conductor tracks having a structure by means of which a plurality of narrow points are formed between the immediately adjacent electrodes similar to conductor tracks, and wherein the electrodes similar to a conductor track are an integral part of a laminate which is adhesively bonded to the outer side of the discharge vessel by means of an adhesive layer and comprises a carrier film made of an electric insulating material, the laminate being positioned such that the narrow points of the electrode tracks are coordinated with the regions between the supporting projections.

* * * * *